313-414 SR
7/23/85 XR 4,531,075

United States Patent [19]

Stone

[11] Patent Number: 4,531,075

[45] Date of Patent: Jul. 23, 1985

[54] ELECTRON GUN HAVING ARC SUPPRESSION MEANS

[75] Inventor: Robert P. Stone, Lancaster, Pa.

[73] Assignee: RCA Corporation, Princeton, N.J.

[21] Appl. No.: 424,140

[22] Filed: Sep. 27, 1982

[51] Int. Cl.[3] ..... H01J 29/96
[52] U.S. Cl. ..... 315/3; 313/414
[58] Field of Search ..... 315/3, 16; 313/414

[56] References Cited

U.S. PATENT DOCUMENTS

| | | | |
|---|---|---|---|
| 2,829,292 | 4/1958 | De Vere Krause | 313/82 |
| 2,957,106 | 10/1960 | Moodey | 313/414 X |
| 3,295,008 | 12/1966 | Gallaro et al. | 315/3 |
| 3,355,617 | 11/1967 | Schwartz et al. | 313/82 |
| 3,758,802 | 9/1973 | Kubo et al. | 313/64 |
| 3,882,348 | 5/1975 | Paridaens | 313/450 |
| 3,909,655 | 9/1975 | Grimmett et al. | 313/450 |
| 3,932,786 | 1/1976 | Campbell | 315/3 |
| 3,950,667 | 4/1976 | DeJong et al. | 313/450 |
| 3,987,329 | 10/1976 | Yamazaki et al. | 313/444 X |
| 4,032,811 | 6/1977 | Schwartz et al. | 313/417 |
| 4,101,803 | 7/1978 | Retsky et al. | 315/3 |
| 4,143,298 | 3/1979 | Bing et al. | 315/3 |
| 4,220,893 | 9/1980 | Miller et al. | 313/450 |
| 4,243,911 | 1/1981 | Winarsky et al. | 315/3 |
| 4,255,689 | 3/1981 | Fischman et al. | 315/3 |
| 4,285,990 | 8/1981 | Hernqvist | 427/39 |
| 4,334,169 | 6/1982 | Takenaka et al. | 313/449 X |
| 4,345,185 | 8/1982 | Kobori | 315/3 |

FOREIGN PATENT DOCUMENTS 1273703 7/1968 Fed. Rep. of Germany .

OTHER PUBLICATIONS

J. W. Schwartz et al., "Recent Developments in Arc Suppression for Picture Tubes", Zenith Radio Corporation.

S. Takenaka et al., "New Hi-Fi Focus Electron Gun for Color Cathode-Ray Tube", Toshiba Review, pp. 30-35, No. 121, May-Jun. 1979.

Y. Kobori et al., "A Novel Arc-Suppression Technique For Cathode Ray Tubes", IEEE Chicago Spring Conference on CE, Jun. 19, 1980, (Sony Corporation).

*Primary Examiner*—Palmer Demeo
*Attorney, Agent, or Firm*—Eugene M. Whitacre; Dennis H. Irlbeck; Vincent J. Coughlin, Jr.

[57] ABSTRACT

An electron gun having arc suppression means is described. In one of the preferred embodiments of the electron gun, at least one cathode is provided for generating an electron beam along a beam path. A plurality of electrodes are serially disposed along the beam path. The electrodes include at least one low voltage electrode and at least one high voltage electrode. A plurality of resistors interconnect selected ones of the electrodes. The interconnected electrodes normally operate at substantially the same voltage, and the resistors act as a voltage divider in the event of an arc and prevent damaging cascading arcs.

9 Claims, 11 Drawing Figures

ELECTRON GUN HAVING ARC SUPPRESSION MEANS

BACKGROUND OF THE INVENTION

The present invention relates to electron guns, and particularly to a cathode ray tube having an arrangement of electron gun electrodes and current limiting arc-suppression resistors. The arc-suppression resistors, in the case of an electrical arc, will operate as a voltage divider to limit the potential in the gaps between electrodes to less than the full ultor potential, thereby limiting the arc current and preventing damaging cascading arcs.

Cascading arcs are defined as a succession of rapidly initiating arcs between electrodes in high field regions of the electron gun which permit a sufficiently high arc current to pass between electrodes of the electron gun and to subsequently damage the electron gun elements or the associated circuitry.

A conventional cathode-ray tube, for example, a color television picture tube, consists of an evacuated envelope having a neck portion, a faceplate and a funnel portion therebetween. An electron gun is disposed in the neck portion of the envelope, and a tricolor emitting phosphor screen is disposed on the interior surface of the faceplate. A shadow mask is located between the electron gun and the screen, in spaced relation to the screen. The electron gun comprises a plurality of electrodes for focusing and accelerating three electron beams toward the phosphor screen. Typically, several high voltage and low voltage electrodes are serially arranged along the electron beam paths to facilitate the focusing and accelerating of the electron beams. The high voltage electrodes typically operate at an ultor potential of about 30 kilovolts, and the low voltage electrodes typically operate at about 8 to 10 kilovolts or less; however, in some electron guns, an intermediate potential of about 12 kilovolts and a low potential of about 8 kilovolts or less are utilized. A conductive coating having an effective resistance of about 100 ohms is disposed on the interior surface of the funnel portion of the envelope. The interior conductive coating operates at ultor potential. Bulb spacers mounted on the electron gun electrode nearest the phosphor screen contact the interior conductive coating to provide ultor potential to the electron gun. An exterior conductive coating, electrically isolated from the interior conductive coating is provided on the outside of the funnel to facilitate grounding of the envelope. The interior and exterior conductive coatings on the funnel also serve as a large capacitor which filters the high voltage.

The large voltage difference established between the high voltage and low voltage electrodes in the electron gun creates a possibility of arcing between the electrodes. The possibility of arcing is increased by irregular electrode surfaces, foreign matter in the interelectrode gaps and by misalignment or improper spacing between electrodes. When an arc occurs, the high voltage filter capacitor will, within a few microseconds or less, discharge its stored charge.

Because the instantaneous peak arc currents can approach hundreds or even thousands of amperes in magnitude, great destruction can be caused by such arcs. The external electron gun circuitry can be damaged by transient currents and voltages induced into the associated receiver circuitry. The gun electrodes can be burned or eroded to the point of inoperability, and electrode material may be sputtered onto adjacent surfaces resulting in the creation of leakage paths between tube elements.

In order to reduce tube arcing and to minimize the damage caused thereby, it is common to design cathode-ray tubes with maximum electrode spacings, to minimize field gradients and to incorporate arc suppression systems into the tube.

U.S. Pat. No. 2,829,292 issued to De Vere Krause on Apr. 1, 1958 describes one of the earliest attempts to limit arc currents to nondestructive levels. In the De Vere Krause structure, a high-resistance internal coating having a resistance of about 1 megohm is provided over a portion of the neck of the envelope. The high-resistance coating is disposed between the end of the electron gun nearest the screen and the conventional anode coating on the interior surface of the funnel. When an arc occurs between adjacent electrodes, the high-resistance coating limits the arc current to a fraction of an ampere. Unfortunately, the conductive metal film released during the getter flash frequently shunts the high-resistance coating so that the arc suppression structure described in the De Vere Krause patent is unreliable. Variations of the De Vere Krause structure using resistive coatings or discrete resistors between the anode coating on the funnel and the electron gun have been proposed by other workers in the art.

U.S. Pat. No. 4,101,803 issued to Retsky et al. on July 18, 1978 discloses an arc suppression structure utilizing both a resistive anti-static neck coating extending between the electron gun and the conventional anode coating, and a discrete resistor in the antenna getter support wire, i.e., a parallel resistive network. Both the anti-static coating and the resistive surface portion of the discrete resistor are formed of a resistive frit. A drawback of the resistive frit arc-suppression system is the disclosure that the resistance decreases by several orders of magnitude following the vacuum bake of the tube. This means that the value of the resistance cannot be accurately determined until a point in the tube processing when the resistance cannot be altered. Additionally, Retsky et al. admit that tubes have not yet been constructed in which no arcing whatsoever occurs. In such tubes, if an arc occurs across the parallel resistor network, a high probability exists that the arc will cascade between the adjacent electrodes and damage the gun circuitry. Thus, there exists a need for an arc-suppression system which will minimize the damage to the gun elements and the associated circuitry by limiting the arc current.

Such a structure is disclosed in U.S. Pat. No. 4,345,185 issued to Y. Kobori on Aug. 17, 1982 and discussed by Y. Kobori et al. in their paper entitled, "A Novel Arc-Suppression Technique For Cathode Ray Tubes", presented at the IEEE Chicago Spring Conference on Consumer Electronics, June 19, 1980. In the Kobori structure, a ceramic resistor is connected between the G3 and G5 high voltage electrodes (typically 30 kV) and another resistor is connected between the low voltage G4 electrode and the stem lead attached thereto. Such a structure is shown in FIGS. 3 and 4. When arcing takes place between adjacent electrodes, the arc current may flow either from the G5 through G3 to the G2 or to the G4. As will be described in detail hereinafter, a problem occurs when the initial arc and the resulting plasma generated thereby results in additional arcs, e.g., cascading arcs, between the other electrodes of the electron gun across the interelectrode gaps A, B and C of FIG. 4. In this case, the full arc current flows through the gun electrodes into the receiver causing possible damage to the electron gun components and to the associated gun circuitry.

Therefore, an arc-suppression system must be able to protect the electron gun not only from the effects of individual arcs but from the effects of a multiple arc. A multiple arc is herein defined as a succession of rapidly occurring arcs resulting from an initial arc. The arc-suppression system should be one in which the arc current is properly limited to prevent damage to the gun elements and to the gun circuitry.

SUMMARY OF THE INVENTION

An electron gun comprises at least one cathode for generating an electron beam along a beam path and a plurality of electrodes serially disposed along the beam path. The electrodes include at least one low voltage electrode and at least one high voltage electrode. A plurality of resistors interconnect selected ones of the electrodes. The interconnected electrodes normally operate at substantially the same voltage, and the resistors act as a voltage divider in the event of an arc. The resistors limit the arc current and prevent damaging cascading arcs.

DETAILED DESCRIPTION OF THE PREFERRED EMBODIMENT

Figure 1:
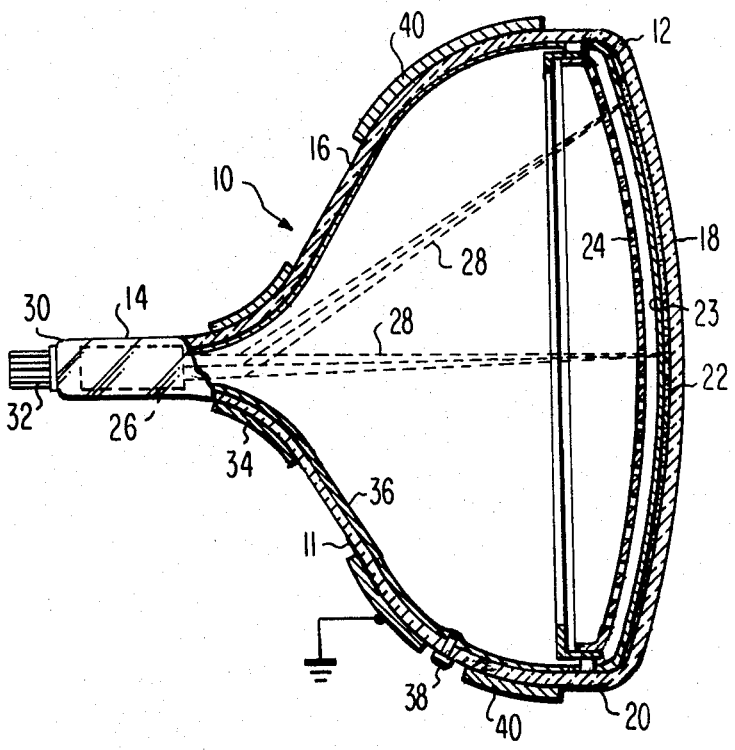
FIG. 1 is a plan view, partially in axial section, of a color cathode-ray tube (CRT) in which the present invention is incorporated.

FIG. 1 is a plan view of a rectangular color cathode-ray tube (CRT) or picture tube 10 having an evacuated glass envelope 11 comprising a rectangular faceplate panel 12 and a tubular neck 14 connected by a rectangular funnel 16. The panel comprises a viewing faceplate 18 and a peripheral flange or sidewall 20 which is sealed to the funnel 16. A mosaic three-color phosphor screen 22, which is backed by a reflective metal layer 23 of aluminum metal, is supported on the inner surface of the faceplate 18. The screen 22 may be either a line screen or a dot screen. A multiapertured color selection electrode or shadow mask 24 is removably mounted, by conventional means, in predetermined spaced relation to the screen 22. A novel in-line electron gun 26, shown schematically by dashed lines in FIG. 1, is centrally mounted within the neck 14 to generate and direct three electron beams 28 along co-planar convergent beam paths through the mask 24 to the screen 22. The end of the neck 14 is closed by a stem 30 having a plurality of terminal pins or stem leads 32 on which the electron gun 26 is mounted and through which electrical connections are made to the various elements of the electron gun 26.

The tube of FIG. 1 is designed to be used with an external magnetic deflection yoke, such as the yoke 34 schematically shown surrounding the neck 14 and funnel 16 in the neighborhood of their junction. The yoke 34 subjects the three beams 28 to vertical and horizontal magnetic flux to scan the beams horizontally and vertically, respectively, in a rectangular raster over the screen 22.

Figure 2:
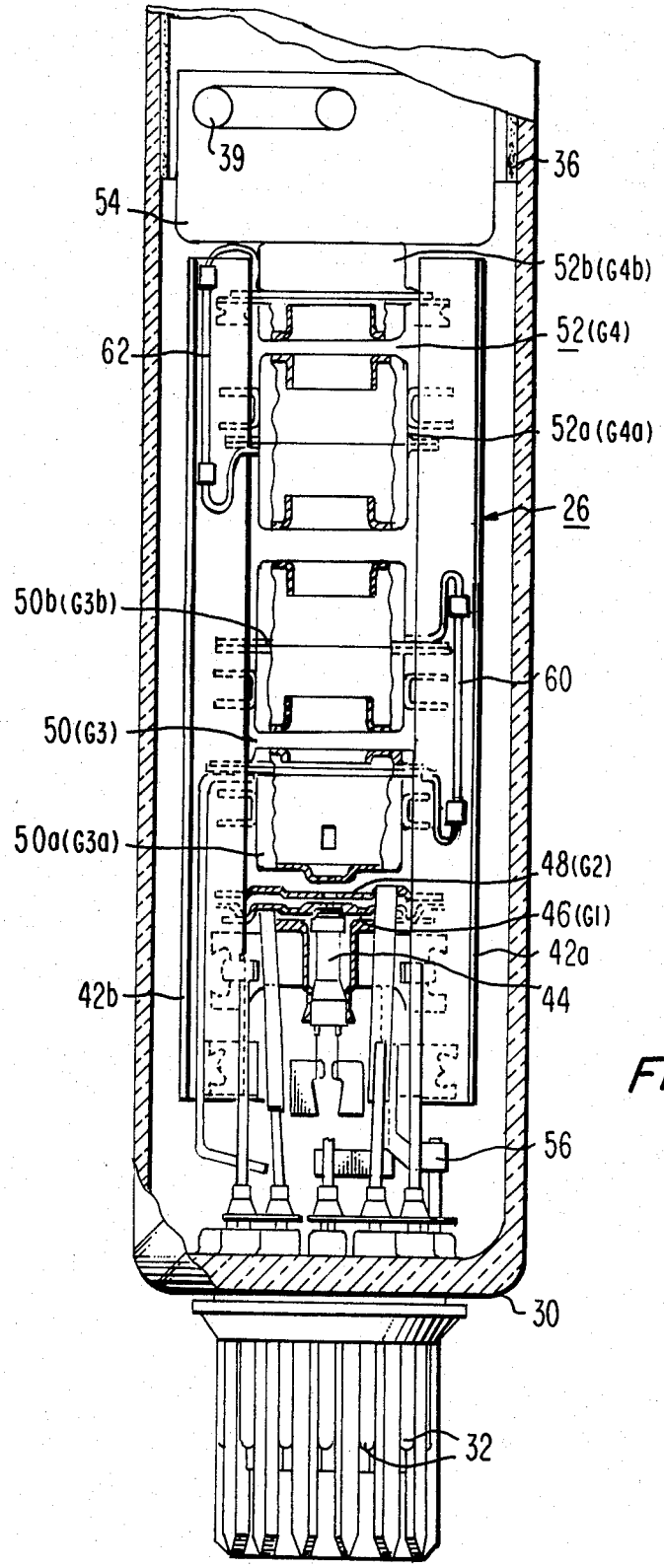
FIG. 2 is a side elevational view of a novel electron gun according to the present invention having two arc-suppression resistors interconnecting two pairs of electrodes.

An opaque, conductive coating 36 comprising graphite, iron oxide and a silicate binder is provided on the inner surface of the funnel 16. The coating 36 has a resistance of about 100 ohms and is electrically connected to the high voltage terminal or anode button 38 in the funnel 16. As shown in FIG. 2, the coating 36 extends into the neck 14 and is contacted by three bulb spacers 39 (only one of which is shown), which are perferably made of spring steel, and which also center and position the extended end of the electron gun 26 with the longitudinal axis of the tube 10.

An outer conductive coating 40, which is maintained at ground potential, is provided on the outside surface of the funnel 16. The inner and outer conductive coatings 36 and 40 constitute a high voltage filter capacitor, $C_f$. The capacitive value of the filter capacitor, $C_f$, is about 1000 picofarads.

The novel in-line bipotential electron gun 26 shown in FIG. 2 comprises two glass support rods or beads **42*a* and 42*b* from which the various electrodes are supported to form a coherent unit in a manner commonly used in the art. These electrodes include three substantially equally transversely-spaced coplanar cathodes 44 (one for producing each beam, although only one is shown), a control-grid electrode 46 (also referred to as G1), a screen-grid electrode 48 (also referred to as G2), a first accelerating and focusing electrode 50 (also referred to as G3), a second accelerating and focusing electrode 52 (also referred to as G4), and a shield cup 54, longitudinally-spaced in that order along the rods 42*a* and 42*b*. Several of the various electrodes of the electron gun 26 are electrically connected to the pins 32 either directly or through metal ribbons 56. The electron gun 26 is held in a predetermined position in the neck 14 on the pins 32 and with bulb spacers 39 on the shield cup 54 which press on and make contact with the internal coating 36**.

Figure 5:
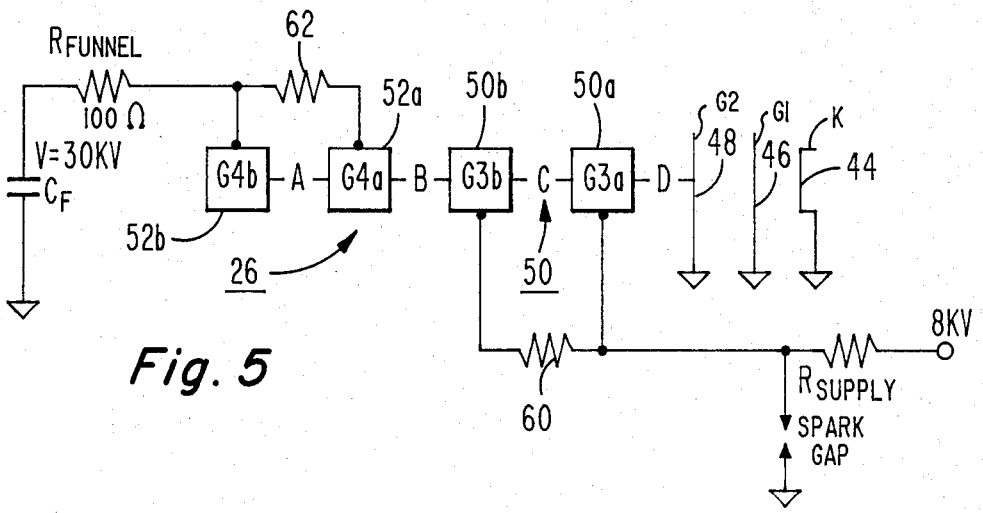
FIG. 5 is a simplified schematic block diagram of the electron gun shown in FIG. 2 including connections to the operating voltages.

The novel electron gun 26 has a split G3 electrode 50, comprising a G3*a* or first proximal electrode member **50*a*** and a G3*b* or first distal electrode member **50*b*. The electron gun 26 also has a split G4 electrode 52** comprising a G4*a* or second proximal electrode member **52*a*** and a G4*b* or second distal electrode member **52*b*. In the present electron gun 26, the terms proximal and distal refer to positions relative to the cathodes 44, wherein the proximal split electrode members are nearer to the cathodes than the corresponding distal split electrode members. The electrode members of the split electrodes in the present embodiment and in the embodiments described hereinafter are axially separated along a plane substantially perpendicular to the electron beam paths. A first arc-suppression resistor 60** is interconnected between the G3*a* and G3*b* electrode members **50*a* and 50*b* of the G3 electrode 50. The end of the resistor 60, which is attached to electrode member 50*a*, is electrically connected, through member 50*a* to one of the stem leads 32. A second arc-suppression resistor 62** is interconnected between the G4*a* and G4*b* electrode members 52*a* and 52*b* of the G4 electrode 52. The end of the resistor 62 that is connected to electrode member 52*b* is also connected, through bulb spacers 39, to the inner coating 36. A schematic block diagram of the split G3, split G4 electron gun 26 is shown in FIG. 5. For simplicity, a single cathode (K) 44 is shown, and the cathode, G1 and G2 electrodes 46 and 48, respectively, are shown as being grounded. The simplified representation of ground potential on the cathode, G1 and G2 electrodes is substantially correct because the actual potentials are low, of the order of hundreds of volts, compared to the 8 kilovolts on the split G3 electrode members 50*a* and 50*b*, and the 30 kilovolts on the split G4 electrode members 52*a* and 52*b*. The spark gap and internal impedance of the power supply represented by the supply resistor, $R_{supply}$, shown in FIG. 5 are external to the electron gun 26 and form no part of the claimed invention.

The operation of the electron gun 26, shown in FIG. 5, can be described with reference to Table I. The spacing between electrodes is such that it is postulated that an arc or breakdown between adjacent electrodes, normally will not occur up to at least 20 kilovolts, but breakdown will probably occur at 30 kilovolts. However, to facilitate analysis of the gun performance, breakdown modes at voltages below 20 kilovolts will also be investigated. Breakdowns below 20 kilovolts may be initiated by irregular electrode surfaces or any of the causes listed heretofore. Table I lists the initial voltages in kilovolts applied to the electrodes as well as the initial voltages across the gaps between electrodes. The gaps are designed by the letters A, B, C and D. Table I also postulates the resultant voltage distribution on the electrodes and across the gaps for two initial breakdown possibilities and for a multiple arc resulting from one of the initial breakdowns. The first possibility is for an arc across gap B, i.e., between the distal G3*b* electrode member 50*b* and the proximal G4*a* electrode member 52*a*. The second possibility is for an arc across gap D between the G2 electrode 48 and the proximal G3*a* electrode member 50*a*. Finally, the case of a multiple arc across gaps B and D is considered.

TABLE I

| Parameter | G4b (kV) | A (kV) | G4a (kV) | B (kV) | G3b (kV) | C (kV) | G3a (kV) | D (kV) | G2 (kV) | $R_{eff}$ |
|---|---|---|---|---|---|---|---|---|---|---|
| Initial Condition | 30 | 0 | 30 | 22 | 8 | 0 | 8 | 8 | 0 | ∞ |
| Arc at B | 30 | 15 | 15 | 0 | 15 | 15 | 0 | 0 | 0 | 2R |
| Arc at D | 30 | 0 | 30 | 30 | 0 | 0 | 0 | 0 | 0 | $R_{supply}$ |
| Arcs at B & D | 30 | 15 | 15 | 0 | 15 | 15 | 0 | 0 | 0 | 2R |

With reference to Table I and FIG. 5, initially, energizing voltages, represented as ground potential, are applied to the G1 electrode 46 and to the G2 electrode 48. A potential of about 8 kilovolts is applied to both electrode members 50*a* and 50*b* of the G3 electrode which are interconnected by the resistor 60. Ultor potential of about 30 kilovolts is applied through the resistive funnel coating to both electrode members 52*a* and 52*b* of the G4 electrode which are interconnected by the resistor 62. During normal operation, the leakage current flowing between the electrodes of the electron gun 26 is typically of the order of about 10 microamperes or less; therefore, the value of the resistors 60 and 62 are selected to provide a minimum potential difference between each of the split electrode members 50*a* and 50*b* and 52*a* and 52*b*. For example, if the resistors 60 and 62 are selected to have a value of about $1.5\times10^4$ ohms, the voltage drop across each resistor, at 10 microamperes leakage current, would be of the order of 0.15 volts. The maximum value of the resistors 60 and 62 has been determined to be about $1.7\times10^7$ ohms; although about $1.5\times10^4$ ohms is preferred. In the following analysis, it will be assumed that the resistors 60 and 62 each have a value of $1.5\times10^4$ ohms; however, the values do not have to be equal, and higher resistance values may be utilized to further reduce the arc current. With the voltages given above applied to the electron gun 26, the potential difference across gap A is zero since both electrode members 52*a* and 52*b* of the split G4 electrode are at the same, 30 kV, potential. Also, since both electrode members 50*a* and 50*b* of the split G3 electrode are at the same 8 kV potential, the potential difference across gap C is zero. However, a potential difference of 22 kV exists across gap B since the G3*b* first distal electrode member 50*b* operates at 8 kV, and the G4*a* second proximal electrode member 52*a* operates at 30 kV. The potential difference across gap D is 8 kV since the G2 electrode 48 operates at essentially ground potential while 8 kV is provided to the G3*a* first proximal electrode member 50*a*. During normal operation of the electron gun 26, the effective resistance, $R_{eff}$, of the gun, is substantially infinite.

In the event an arc occurs across gap B, the resistors 60 and 62 now function as a voltage divider to limit the arc current to a safe level. As shown in Table I, 30 kV is still applied to the G4*b* second distal electrode member 52*b*, but about half of the voltage is dropped across resistor 62 so that only 15 kV is present on the G4*a* second proximal electrode member 52*a*. Because of the arc across gap B, the same 15 kV is also present on the G3*b* first distal electrode member 50*b*. With 15 kV present on electrode member 50*b*, the spark gap will break down lowering the potential on the G3*a* first proximal electrode 50*a* to ground potential. When an arc occurs across gap B, the effective resistance, $R_{eff}$, of the electron gun 26 has been determined to be twice the resistance of the individual resistors 60 and 62. Assuming lhat the resistors 60 and 62 each have a value of $1.5\times10^4$ ohms, the maximum arc current is about 1 ampere. Such an arc current will not damage either the electrodes of the electron gun or the associated circuitry.

In the event an arc occurs across gap D, the potential of 30 kV applied to the G4*a* and G4*b* electrode members 52*a* and 52*b* will initially be undisturbed; however, the potential on both of the G3*a* and G3*b* electrode members 50*a* and 50*b* will decrease to ground potential. In this event, an unstable condition exists across gap B since the potential on the G3*b* first distal electrode member 50*b* has dropped to ground potential, while the G4*a* second proximal electrode member 52*a* is at the ultor potential of 30 kV. Frequently, the plasma created by the initial arc across gap D and the high potential across gap B will result in a multiple arc condition where a breakdown will also occur across gap B. However, before considering the multiple arc condition, it should be noted that with a breakdown across gap D, the effective resistance of the electron gun 26 is now the internal impedance of the power supply, $R_{supply}$. By design, the power supply will limit the arc current produced by an arc between the G2 electrode 48 and the G3*a* electrode member 50*a*.

As described above for an arc across gap D, a second arc is also likely to occur across the gap at B because of the 30 kV potential difference between the G3*b* electrode member 50*b* and the G4*a* electrode member 52*a*. This multiple arc condition, i.e., an arc across both gaps B and D, is also considered in the last line of Table I. The resulting voltage distribution, for the multiple arc condition, is the same as that considered above for an arc across gap B only.

The in-line bipotential electron gun 26 having a split G3 electrode 50 and a split G4 electrode 52, and utilizing arc-suppression resistors 60 and 62 provides a gun structure in which the arc current is limited to a level which will not damage either the elements of the electron gun or the associated circuitry. The resistors 60 and 62 do not inhibit the normal tube processing procedures which include spot-knocking of the electron gun electrodes as well as low voltage aging.

Figure 3:
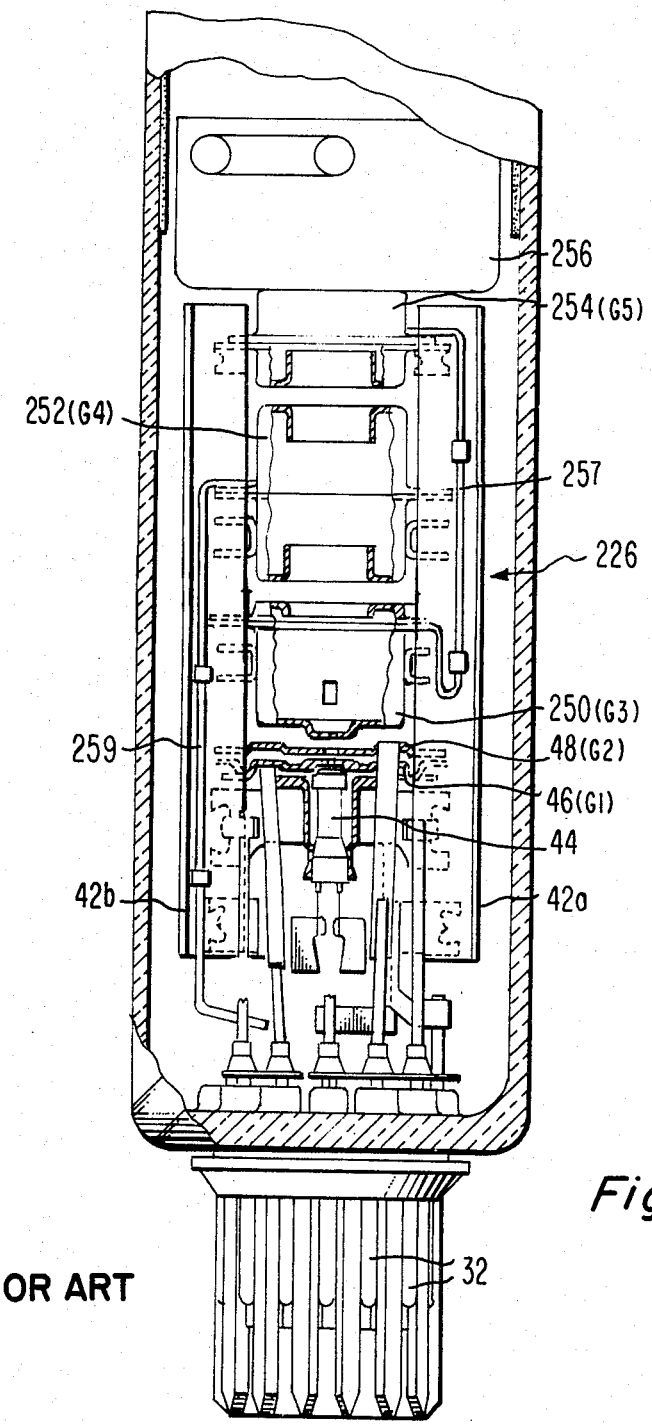
Fig.3 PRIOR ART
FIG. 3 is a side elevational view of a prior art electron gun utilizing arc-suppression resistors.
Figure 4:
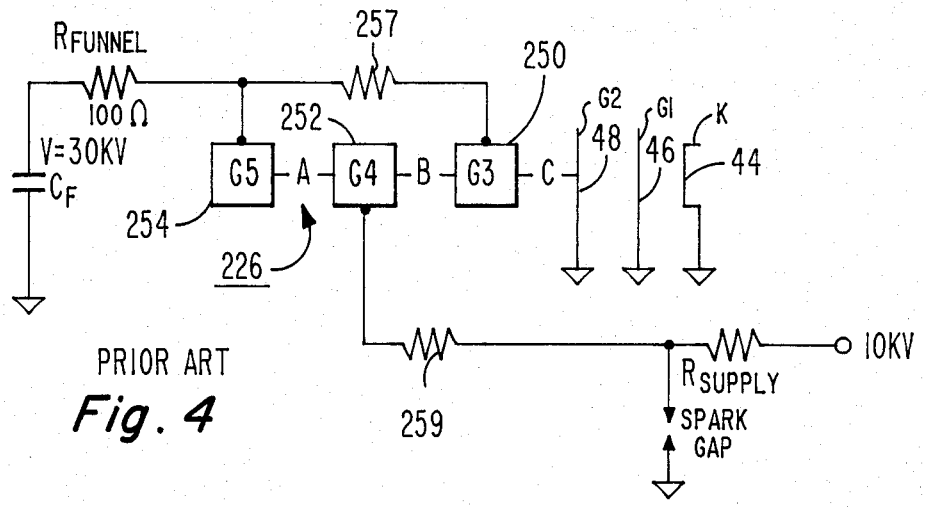
PRIOR ART Fig. 4
FIG. 4 is a simplified schematic block diagram of the electron gun shown in FIG. 3 including the connections to the operating voltages.

In contrast, an einzel or a uni-potential gun 226 similar to the gun described in U.S. Pat. No. 4,345,185 to Kobori is shown in FIGS. 3 and 4 and analyzed in Table II.

TABLE II

| Parameter | G5 (kV) | A (kV) | G4 (kV) | B (kV) | G3 (kV) | C (kV) | G2 (kV) | $R_{eff}$ |
|---|---|---|---|---|---|---|---|---|
| Initial Condition | 30 | 20 | 10 | 20 | 30 | 30 | 0 | ∞ |
| Arc at A | 30 | 0 | 30 | 0 | 30 | 30 | 0 | R |
| Arc at B | 30 | 15 | 15 | 0 | 15 | 15 | 0 | 2R |
| Arc at C | 30 | 20 | 10 | 10 | 0 | 0 | 0 | R |
| Arcs at A & C | 30 | 0 | 30 | 30 | 0 | 0 | 0 | R/2 |
| Arcs at A & B | 30 | 0 | 30 | 0 | 30 | 30 | 0 | R |
| Arcs at A, B & C | 0 | 0 | 0 | 0 | 0 | 0 | 0 | $R_{funnel}$ |

The uni-potential gun 226 comprises two glass support rods 42*a* and 42*b* to which three substantially equally transversely-spaced co-planar cathodes 44, a G1 or control-grid electrode 46, and a G2 or screen grid electrode 48 are attached in the order named. A G3 or first accelerating and focusing electrode 250, a G4 or second accelerating and focusing electrode 252 and a G5 or third accelerating and focusing electrode 254 are disposed between the G2 electrode 48 and a shield cup 256. A first resistor 257 is interconnected between the G3 electrode 250 and the G5 electrode 254, while a second resistor 259 is connected between the G4 electrode 252 and one of the pins 32 in the base of the tube which, in turn, is connected to a 10 kV power supply (not shown). The resistors 257 and 259 are selected to have a value, as described above, within the range of about $1.5\times10^4$ ohms to about $1.7\times10^7$ ohms.

With reference to FIG. 4 and Table II, initially, low potentials, represented as ground potential, are applied to the G1 and G2 electrodes 46 and 48, respectively. A potential of 10 kV is applied to the G4 electrode 252 and ultor potential, 30 kV, is applied to the G5 electrode 254 and, through the first resistor 257, to the G3 electrode 250. The second resistor 259 is connected between the G4 electrode 252 and the 10 kV power supply. As described above in the analysis of electron gun 26, during normal tube operation, the tube leakage current is very low so little voltage is dropped across the resistor 257 and 259, which are preferably about $1.5\times10^4$ ohms. If it is assumed that the gun electrodes are designed to normally withstand 20 kV and to breakdown at about 30 kV, it is apparent from Table II that the greatest likelihood of arc-over occurs across gap C when a potential difference of 30 kV is present. Of the possible breakdown modes analyzed in Table II, none will cause a cascading arc which will possibly damage the gun electrodes or the associated circuitry with the exception of the breakdown mode in which arcs occur simultaneously across gaps A, B and C. This failure mode can be initiated by the plasma generated by any initial arc and the high potential resulting therefrom. Thus, an initial arc across one gap may trigger a multiple arc across another gap, and a cascading arc across all the gaps may result. In the event of a cascading arc across gaps A, B and C, the protective resistors 257 and 259 are shunted by the arcs and the only resistance between the ultor voltage stored in the high voltage capacitor, formed by the separated inner and outer envelope coatings, and the electron gun 226 is the resistance of the interior funnel coating $R_{funnel}$. Since the funnel resistance is in the neighborhood of 100 ohms or less, arc currents of about 300 amperes or more will pass through the electron gun 226 and into the associated circuitry in the event of a cascading arc across gaps A, B and C. Thus, the structure shown in FIGS. 3 and 4 and described in the Kobori patent is insufficient to protect the electron gun 226 under all possible arc modes.

Figure 6:
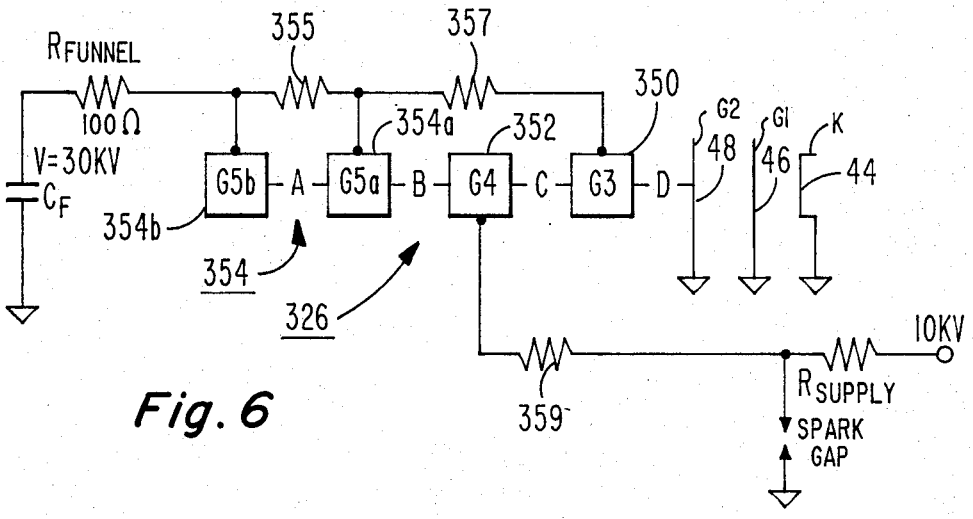
FIGS. 6–11 are simplified schematic block diagrams of alternative embodiments for electron guns utilizing the novel arc-suppression structure and including connections to operating voltages.

FIG. 6 shows a schematic diagram of an improved einzel gun 326. The einzel gun 326 is similar to the conventional einzel gun 226 with the exception that a novel split electrode member and an additional current limiting resistor are provided to prevent cascading arcs. The electron gun 326 comprises at least one cathode 44, a G1 or control grid electrode 46 and a G2 or screen grid electrode 48. A plurality of serially arranged accelerating and focusing electrodes including a G3 or first electrode 350, a G4 or second electrode 352 and a G5 or third electrode 354 are longitudinally disposed, in the order named, along the axis of the gun 326. The G5 electrode 354 includes a split member comprising a G5*a* or proximal member 354 and a G5*b* or distal member 354*b*. A first arc suppression resistor 355 is interconnected between the G5*a* and G5*b* electrode members 354*a* and 354*b*, respectively. A second arc suppression resistor 357 is interconnected between the G5*a* proximal electrode member 354*a* and the G3 electrode 350. A third arc suppression resistor 359 is connected, within the electron gun, between the G4 electrode 352 and the 10 kV power supply. The resistors 355, 357 and 359 are selected to have a value of at least $1.5\times10^4$ ohms, although values as high as about $1.7\times10^7$ ohms may be used. Ultor potential is applied to the G3 and G5 electrodes 350 and 354, respectively, through the resistive funnel coating, while the G4 electrode 352 is connected, through resistor 359 to the low voltage power supply.

An analysis of the performance of the novel, improved einzel gun 326 is summarized in Table III. In the initial operating condition listed in Table III, the greatest potential difference, 30 kV, and hence the greatest probability for breakdown occurs across gap D. By design, the G2 and G3 electrodes 48 and 350, respectively, will normally stand off that potential difference without breakdown. In the event breakdown, i.e., an arc, occurs at gap D, the potentials between the other electrodes do not exceed 15 kV. Since it is assumed that arcing will not normally occur for voltage gradients less than 20 kV, the initial arc is not self-sustaining, and additional arcs are unlikely to occur. The effective resistance in the event of an arc across gap D is twice the value of the supression resistor which is selected to be at least $1.5\times10^4$ ohms. Consequently, the effective resistance is at least $3.0\times10^4$ ohms, and the arc current is limited to one ampere or less. Table III also analyzes the effects of an arc across gaps B and C. In each case, following the occurrence of the arc, the potential differences across the non-arcing gaps decreases to less than 20 kV, thereby reducing the probability of additional arcs. The arc currents are also limited to safe values of less than one ampere.

TABLE III

| Parameter | G5b (kV) | A (kV) | G5a (kV) | B (kV) | G4 (kV) | C (kV) | G3 (kV) | D (kV) | G2 (kV) | $R_{eff}$ |
|---|---|---|---|---|---|---|---|---|---|---|
| Initial Condition | 30 | 0 | 30 | 20 | 10 | 20 | 30 | 30 | 0 | ∞ |
| Arc at B | 30 | 15 | 15 | 0 | 15 | 0 | 15 | 15 | 0 | 2R |
| Arc at C | 30 | 10 | 20 | 10 | 10 | 0 | 10 | 10 | 0 | 3R |
| Arc at D | 30 | 15 | 15 | 5 | 10 | 10 | 0 | 0 | 0 | 2R |

Figure 7:
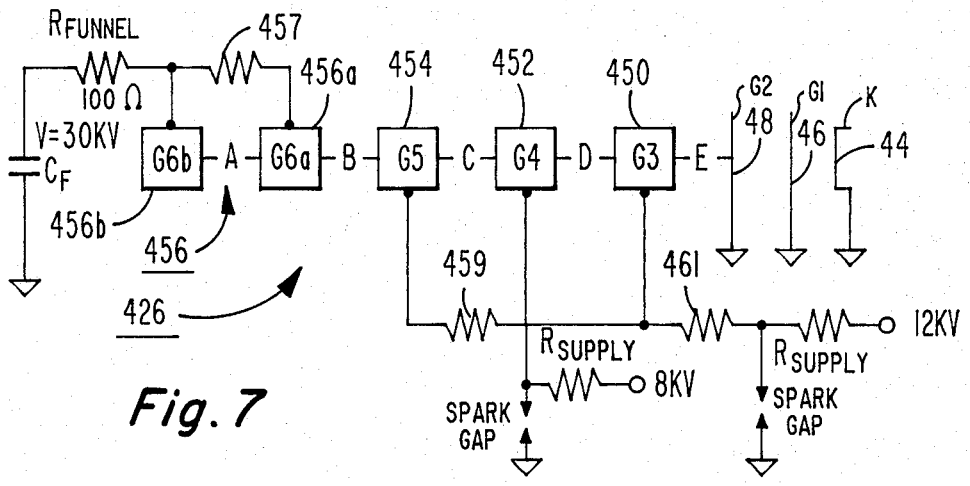

A tripotential electron gun 426 is schematically shown in FIG. 7. In this embodiment of the electron gun 426, at least one cathode 44, a G1 or control grid electrode 46, a G2 or screen grid electrode 48 and four accelerating and focusing electrodes comprising a G3 electrode 450, a G4 electrode 452, a G5 electrode 454 and a G6 electrode 456 are serially disposed along the axis of the gun in the order named. The G6 electrode 456 is a split element comprising a G6*a* proximal member 456*a* and a G6*b* distal member 456*b*. A first arc suppression resistor 457 is interconnected between the G6*a* proximal electrode member 456*a* and the G6*b* distal electrode member 456*b*. A second arc suppression resistor 459 is connected between the G3 electrode 450 and the G5 electrode 454. A third arc suppression resistor 461 is connected, within the electron gun, between the G3 electrode 450 and the 12 kV intermediate voltage power supply. The resistors 457, 459 and 461 are selected to have a value of at least $1.5\times10^4$ ohms to about $1.7\times10^7$ ohms, although $1.5\times10^4$ ohms is preferred. Ultor potential is provided to the G6 electrode 456 through the resistive funnel coating. An intermediate potential is applied to the G3 and G5 electrodes 450 and 454, respectively, while a low potential is applied to the G4 electrode 452.

An analysis of the performance of the tripotential electron gun 426, having the split G6 electrode 456, is summarized in Table IV. Under normal operating conditions, the potential differences across gaps A through E does not exceed 18 kV, so the probability of an arc is low; however, if an arc should occur, e.g., across gap E, then a potential difference of 30 kV occurs across gap B. In the event that a multiple arc occurs across both gaps B and E, the potential differences between the remaining gaps does not exceed 15 kV, and the arc will be extinguished. The effective resistance of the electron gun 426 for a multiple arc occurring across gaps B and E is twice the value of the arc-suppression resistor, or about $3\times10^4$ ohms. The arc current is therefore limited to a value of one ampere or less.

TABLE IV

| Parameter | G6b (kV) | A (kV) | G6a (kV) | B (kV) | G5 (kV) | C (kV) | G4 (kV) | D (kV) | G3 (kV) | E (kV) | G2 (kV) | $R_{eff}$ |
|---|---|---|---|---|---|---|---|---|---|---|---|---|
| Initial Condition | 30 | 0 | 30 | 18 | 12 | 4 | 8 | 4 | 12 | 12 | 0 | ∞ |
| Arc at B | 30 | 10 | 20 | 0 | 20 | 12 | 8 | 2 | 10 | 10 | 0 | 3R |
| Arc at E | 30 | 0 | 30 | 30 | 0 | 8 | 8 | 8 | 0 | 0 | 0 | R |
| Arcs at B & E | 30 | 15 | 15 | 0 | 15 | 7 | 8 | 8 | 0 | 0 | 0 | 2R |

Figure 8:
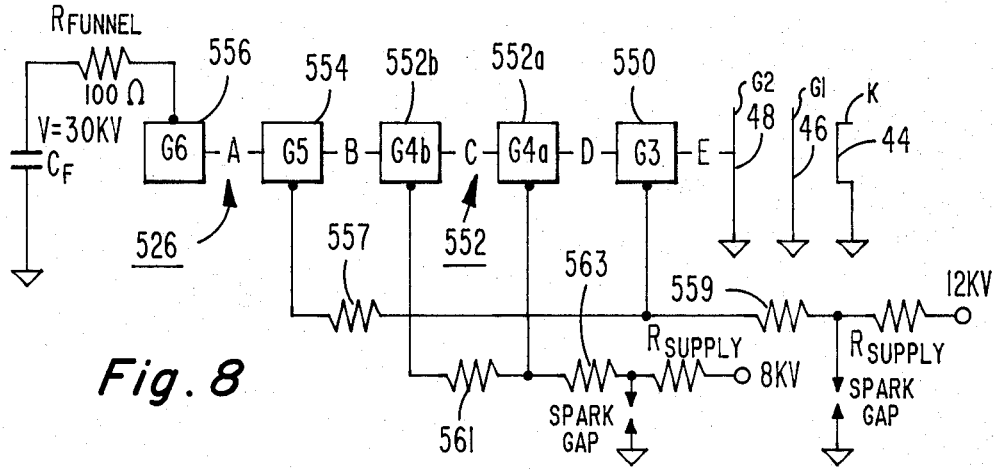

A second embodiment of a tripotential electron gun 526 is shown in FIG. 8. In this embodiment, the electron gun 526 includes at least one cathode 44, a G1 or a control-grid electrode 46, a screen grid electrode 48, and four accelerating and focusing electrodes comprising a G3 electrode 550, a G4 electrode 552, a G5 electrode 554 and a G6 electrode 556. The G4 electrode 552 is a split element comprising a G4*a* proximal electrode member 552*a* and a G4*b* distal electrode member 552*b*.

A first arc suppression resistor 557 is interconnected between the G3 electrode 550 and the G5 electrode 554. A second arc suppression resistor 559 is connected, within the electron gun, between the G3 electrode 550 and the 12 kV intermediate voltage power supply. A third arc suppression resistor 561 is interconnected between the G4*a* proximal electrode member 552*a* and the G4*b* distal electrode member 552*b*, and a fourth arc suppression resistor 563 is connected, within the electron gun, between the G4*a* proximal electrode member 552*a* and the 8 kV low voltage power supply. Each of the arc suppression resistors 557, 559, 561 and 563 has a value of at least $1.5\times10^4$ ohms to about $1.7\times10^7$ ohms, although $1.5\times10^4$ ohms is preferred.

An analysis of the performance of the tripotential electron gun 526 is contained in Table V. Under normal operating conditions, the greatest potential difference between adjacent electrodes does not exceed 18 kV, so that the probability of an arc is low. Various arc conditions are considered and in every instance, the arc current will be limited to a safe value of about three amperes, assuming that the arc suppression resistors each has a value of $1.5\times10^4$ ohms. A possible drawback of this resistor configuration is that if a multiple arc occurs across gaps A and E, the full voltage, 30 kV, is across the arc suppression resistor 557 connected between the G3 electrode 550 and the G5 electrode 554. Another drawback of the arc-suppression structure for electron gun 526 is that a total of four resistors are used, thereby increasing the cost of the electron gun.

TABLE V

| Parameter | G6 (kV) | A (kV) | G5 (kV) | B (kV) | G4b (kV) | C (kV) | G4a (kV) | D (kV) | G3 (kV) | E (kV) | G2 (kV) | $R_{eff}$ |
|---|---|---|---|---|---|---|---|---|---|---|---|---|
| Initial Condition | 30 | 18 | 12 | 4 | 8 | 0 | 8 | 4 | 12 | 12 | 0 | ∞ |
| Arc at A | 30 | 0 | 30 | 22 | 8 | 0 | 8 | 7 | 15 | 15 | 0 | 2R |
| Arc at E | 30 | 30 | 0 | 8 | 8 | 0 | 8 | 8 | 0 | 0 | 0 | R |
| Arcs at A & B | 30 | 0 | 30 | 0 | 30 | 15 | 15 | 0 | 15 | 15 | 0 | R |
| Arcs at A & E | 30 | 0 | 30 | 22 | 8 | 0 | 8 | 8 | 0 | 0 | 0 | R |
| Arcs at A, B & E | 30 | 0 | 30 | 0 | 30 | 15 | 15 | 15 | 0 | 0 | 0 | ⅓R |

is reduced, and the arc current is limited to about one ampere or less.

TABLE VI

| Parameter | G6 (kV) | A (kV) | G5 (kV) | B (kV) | G4 (kV) | C (kV) | G3b (kV) | D (kV) | G3a (kV) | E (kV) | G2 (kV) | $R_{eff}$ |
|---|---|---|---|---|---|---|---|---|---|---|---|---|
| Initial Condition | 30 | 20 | 10 | 20 | 30 | 20 | 10 | 0 | 10 | 10 | 0 | ∞ |
| Arc at A | 30 | 0 | 30 | 0 | 30 | 15 | 15 | 15 | 0 | 0 | 0 | 2R |
| Arc at B | 30 | 10 | 20 | 0 | 20 | 10 | 10 | 10 | 0 | 0 | 0 | 3R |
| Arc at C | 30 | 15 | 15 | 0 | 15 | 0 | 15 | 15 | 0 | 0 | 0 | 2R |
| Arc at E | 30 | 30 | 0 | 30 | 30 | 30 | 0 | 0 | 0 | 0 | 0 | $R_{supply}$ |
| Arcs at A & E | 30 | 0 | 30 | 0 | 30 | 15 | 15 | 15 | 0 | 0 | 0 | 2R |
| Arcs at B & E | 30 | 10 | 20 | 0 | 20 | 10 | 10 | 10 | 0 | 0 | 0 | 3R |
| Arcs at C & E | 30 | 15 | 15 | 0 | 15 | 0 | 15 | 15 | 0 | 0 | 0 | 2R |

Figure 9:
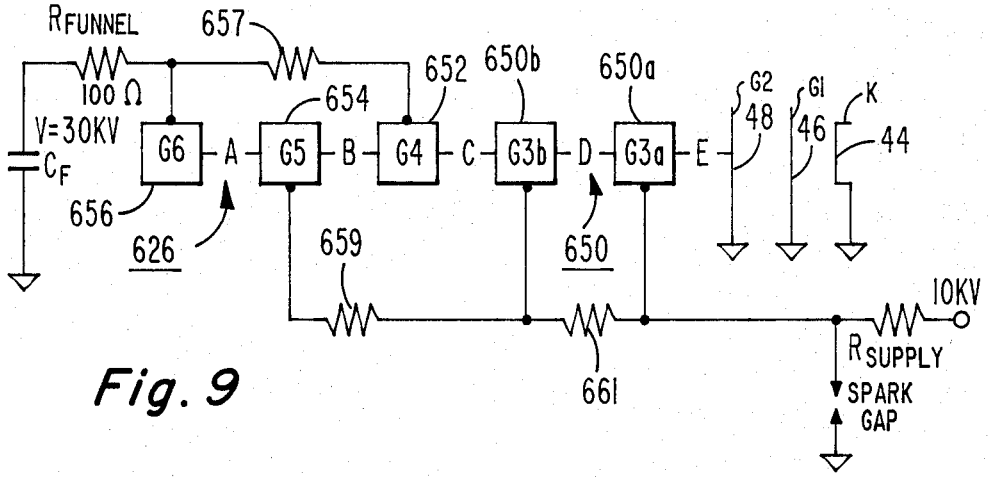

A bipotential-unipotential electron gun 626 is shown in FIG. 9. The electron gun 626 comprises at least one cathode 44, a G1 or control-grid electrode 46, a G2 or screen grid electrode 48, and a plurality of focusing and accelerating electrodes including a G3 electrode 650, a G4 electrode 652, a G5 electrode 654 and a G6 electrode 656. The G3 electrode 650 is a split element comprising a G3*a* proximal electrode member **650*a*** and a G3*b* distal electrode member **650*b*. A first arc suppression resistor 657 is interconnected between the G4 electrode 652 and the G6 electrodes 656. A second arc suppression resistor 659** is interconnected between the G3*b* distal electrode member **650*b* and the G5 electrode 654, while a third arc suppression resistor 661 is interconnected between the proximal and distal members 650*a* and 650*b***, respectively, of the G3*a* and G3*b* electrodes. The G6 electrode 656 is connected to ultor potential, 30 kV, through the resistive funnel coating, and a potential of 10 kV is provided to the G3 and G5 electrodes 650 and 654, respectively. The arc suppression resistors 657, 659 and 661 have a value of at least $1.5\times10^4$ to about $1.7\times10^7$ ohms; however, $1.5\times10^4$ ohms is preferred.

Figure 10:
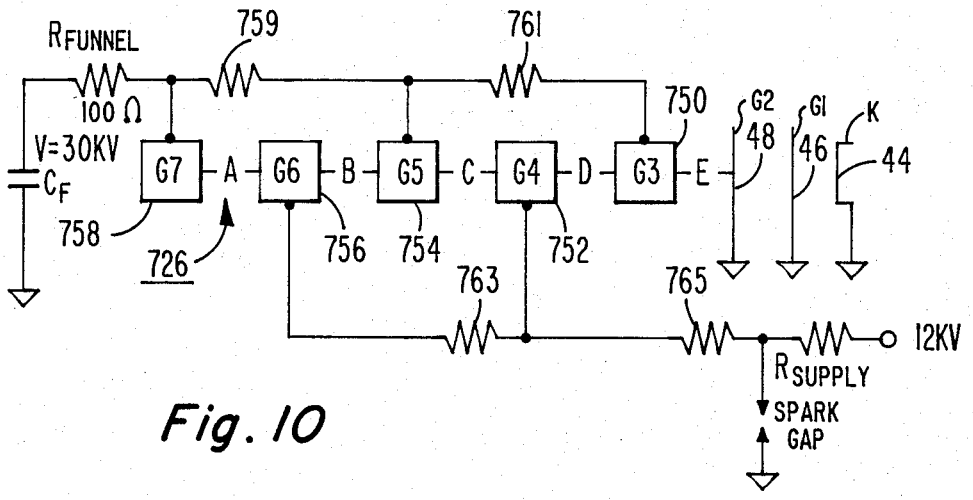

An analysis of the performance of the electron gun 626 is contained in Table VI. Under normal operating conditions, the greatest potential difference, 20 kV, occurs across gaps A, B and C. In the event of an arc across any of the aforementioned gaps, the potential difference across the other gaps decreases, and the effective resistance limits the arc current to less than about one ampere. In the unlikely event of an arc across gap E, which normally has a very low potential difference thereacross, high potential differences are created across gaps A, B and C; however, the internal impedance of the power supply, $R_{supply}$, limits the arc current, by design, to a safe value. In the event that the initial arc at gap E initiates multiple arcs across either gaps A, B or C, the potential across the non-arcing gaps A periodic focus electron gun 726 is shown in FIG. 10. The electron gun 726 comprises at least one cathode 44, a G1 or control grid electrode 46, a G2 or screen grid electrode 48, and a plurality of accelerating and focusing electrodes including a G3 electrode 750, a G4 electrode 752, a G5 electrode 754, a G6 electrode 756 and a G7 electrode 758. A first arc suppression resistor 759 is interconnected between the G5 electrode 754 and the G7 electrode 758. A second arc suppression resistor 761 is interconnected to the G3 electrode 750 and the G5 electrode 754. Ultor potential is applied to the G3, G5 and G7 electrodes 750, 754 and 758 through the resistive funnel coating. The G4 electrode 752 is interconnected to the G6 electrode 756 by means of a third arc suppression resistor 763. A fourth arc suppression resistor 765 is interconnected, within the tube, between the G4 electrode 752 and the 12 kV power supply, which provides an operating potential to the G4 and G6 electrodes 756 and 754, respectively. The value of each of the arc suppression resistors 759, 761, 763 and 765 is at least $1.5\times10^4$ ohms to about $1.7\times$ $^7$ ohms; however, $1.5\times10^4$ ohms is preferred.

An analysis of the performance of the periodic focus electron gun 726 is provided in Table VII. Under normal operating conditions, a potential of 30 kV is applied to the G3, G5 and G7 electrodes 750, 754 and 758, while 12 kV is applied to the G4 and G6 electrodes 752 and 756. The potential difference across each of the gaps A, B, C and D is 18 kV; however, the potential difference across gap E is about 30 kV. In the event of an arc across gap E, the potential difference across gap A remains at 18 kV, while the potential difference across each of the gaps B, C and D decreases to 12 kV or less. Thus, no further breakdown is induced. If, however, the initial arc across gap E should initiate a multiple arc, for example, across gap A, the potential difference across gaps B and D is limited to 15 kV, and the potential difference across gap C is zero. The effective resistance of the electron gun 726 in the event of an arc across gaps A and E is equal to $1.5\times10^4$ ohms, and the corresponding arc current is limited to 2 amperes. The effective resistance of the electron gun 726 is greater than $1.5\times10^4$ ohms for single arc across gaps A through E, and the corresponding arc current is one ampere or less.

TABLE VII

| Parameter | G7 (kV) | A (kV) | G6 (kV) | B (kV) | G5 (kV) | C (kV) | G4 (kV) | D (kV) | G3 (kV) | E (kV) | G2 (kV) | $R_{eff}$ |
|---|---|---|---|---|---|---|---|---|---|---|---|---|
| Initial Condition | 30 | 18 | 12 | 18 | 30 | 18 | 12 | 18 | 30 | 30 | 0 | ∞ |
| Arc at A | 30 | 0 | 30 | 0 | 30 | 15 | 15 | 15 | 30 | 30 | 0 | 2R |
| Arc at B | 30 | 10 | 20 | 0 | 20 | 10 | 10 | 10 | 20 | 20 | 0 | 3R |
| Arc at C | 30 | 15 | 15 | 0 | 15 | 0 | 15 | 0 | 15 | 15 | 0 | 2R |
| Arc at D | 30 | 20 | 10 | 10 | 20 | 10 | 10 | 0 | 10 | 10 | 0 | 3R |
| Arc at E | 30 | 18 | 12 | 3 | 15 | 3 | 12 | 12 | 0 | 0 | 0 | 2R |
| Arcs at A & E | 30 | 0 | 30 | 15 | 15 | 0 | 15 | 15 | 0 | 0 | 0 | R |

Figure 11:
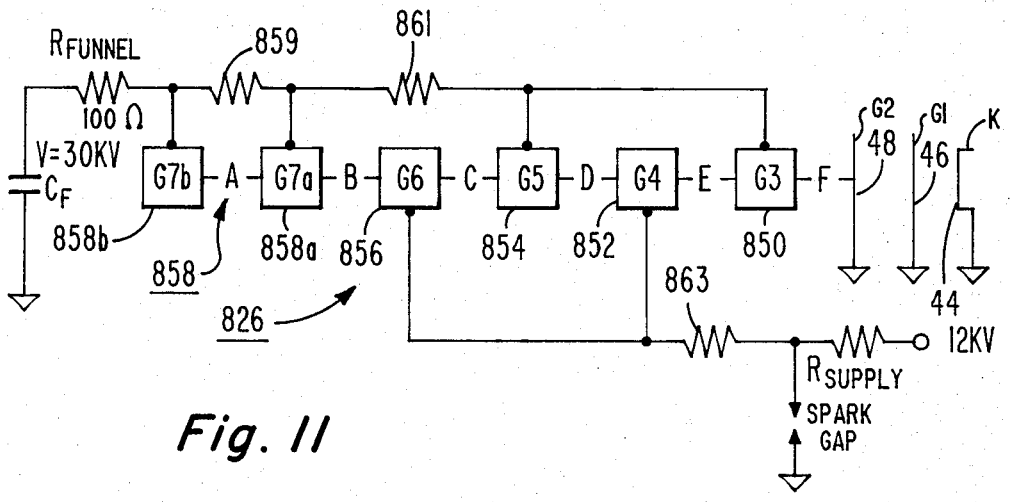

An alternative embodiment of a periodic focus electron gun 826 is shown in FIG. 11. The electron gun 826 is similar to the electron gun 726 in that it comprises at least one cathode 44, a G1 or control grid electrode 46, a G2 or screen grid electrode 48, and a plurality of accelerating and focusing electrodes, including a G3 electrode 850, a G4 electrode 852, a G5 electrode 854, a G6 electrode 856 and a G7 electrode 858. The G7 electrode 858 of the present novel electron gun 826 comprises a split electrode member having a G7*a* proximal electrode member 858*a* and a G7*b* distal electrode member 858*b*. A first arc suppression resistor 859 is interconnected between the G7*a* proximal electrode member 858*a* and the G7*b* distal electrode member 858*b*. A second arc suppression resistor 861 is interconnected between the G5 electrode 854 and the G7*a* electrode 858*a*. A third arc suppression resistor 863 is connected, within the electron gun 826, between the G4 electrode 852 and the low voltage 12 kV power supply. The arc suppression resistor 859, 861 and 863 preferably have a value $1.5\times10^4$ ohms; however, a value of as much as $1.7\times10^7$ ohms may be used. Ultor potential is applied, through the resistive funnel coating, to both elements of the split G7 electrode 858, to the G5 electrode 854 and to the G3 electrode 850. Twelve kilovolts is applied to the G4 electrode 852 and to the G6 electrode 856. A potential that is low in comparison to those applied to electrodes G3 through G7 and which can be approximated by ground potential is applied to the G2 electrode 48.

An analysis of the performance of the periodic focus electron gun 826, having a split G7 electrode 858, is listed in Table VIII. With the operating potentials described herein applied to the various electrodes, the potential difference across gaps A, B, C, D and E does not exceed 18 kV; however, 30 kV occurs across gap F. In the event of an arc across any one of the gaps A through E, the potential across all of the gaps, with the exception of across gap A, drops to 15 kV or less. Since the initial potential difference across gap A was zero, an arc across any of the gaps B through F raises the potential difference across gap A; however, the gap A potential difference never exceeds 15 kV. Thus, the likelihood of a multiple arc occurring in electron gun 826 is remote. In the event of a single arc across gaps B through F, the effective electron gun resistance ranges from two to three times the value of the individual arc suppression resistor 859, 861 and 863, i.e., a value ranging from about $3.0\times10^4$ ohms to about $4.5\times10^4$ ohms. The arc current is therefore limited to one ampere or less.

TABLE VIII

| Parameter | G7b (kV) | A (kV) | G7a (kV) | B (kV) | G6 (kV) | C (kV) | G5 (kV) | D (kV) | G4 (kV) | E (kV) | G3 (kV) | F (kV) | G2 (kV) | $R_{eff}$ |
|---|---|---|---|---|---|---|---|---|---|---|---|---|---|---|
| Initial Condition | 30 | 0 | 30 | 18 | 12 | 18 | 30 | 18 | 12 | 18 | 30 | 30 | 0 | ∞ |
| Arc at B | 30 | 15 | 15 | 0 | 15 | 0 | 15 | 0 | 15 | 0 | 15 | 15 | 0 | 2R |
| Arc at C | 30 | 10 | 20 | 10 | 10 | 0 | 10 | 0 | 10 | 0 | 10 | 10 | 0 | 3R |
| Arc at D | 30 | 10 | 20 | 10 | 10 | 0 | 10 | 0 | 10 | 0 | 10 | 10 | 0 | 3R |
| Arc at E | 30 | 10 | 20 | 10 | 10 | 0 | 10 | 0 | 10 | 0 | 10 | 10 | 0 | 3R |
| Arc at F | 30 | 15 | 15 | 3 | 12 | 12 | 0 | 12 | 12 | 12 | 0 | 0 | 0 | 2R |

The arc-suppression resistor described herein for all the novel embodiments is preferably a resistor manufactured by Carborundum Corporation or an equivalent resistor.

What is claimed is:

1. In an electron gun comprising at least one cathode for generating an electron beam along a beam path and a plurality of electrodes serially disposed along the beam path, said electrodes including at least one low voltage electrode and at least one high voltage electrode, wherein the improvement comprises a plurality of resistors interconnecting selected ones of said electrodes, at least one electrode of said plurality of electrodes being a split member comprising two spaced apart sections interconnected by one of said plurality of resistors, said interconnected sections normally being operable at substantially the same voltage, whereby said resistors act as a voltage divider in the event of an arc to limit the arc current and prevent damaging cascading arcs.

2. In a cathode ray tube comprising an evacuated envelope having therein a phosphor screen, and an electron gun, said electron gun including a plurality of cathodes for generating a plurality of electron beams along spaced beam paths towards said screen, a plurality of electrodes for focusing and accelerating the electron beams, the electrodes including a control-grid electrode, a screen-grid electrode, at least one accelerating and focusing electrode, and a shield cup, the cathodes, the electrodes and the shield cup being longitudinally spaced along a pair of support rods in the order named, the improvement wherein said accelerating and focusing electrode comprises a split member having two spaced apart electrode sections, a first resistor interconnecting said spaced-apart electrode sections of said split member, and a second resistor interconnecting two other electrodes of said plurality of electrodes, said first and second resistors acting as a voltage divider in the event of an arc to limit the voltage difference between said electrodes and prevent damaging cascading arcs.

3. The cathode ray tube as described in claim 2, wherein said spaced apart electrode sections of said split member are axially separated along a plane substantially perpendicular to the beam paths.

4. The cathode ray tube as described in claim 2, wherein said two other electrodes comprise spaced apart electrode sections of a second accelerating and focusing electrode, said spaced apart sections being axially separated along a plane substantially perpendicular to the beam paths.

5. In a cathode ray tube comprising an evacuated envelope having therein a phosphor screen, and an inline electron gun, said electron gun including a plurality of cathodes for generating a plurality of electron beams along spaced, coplanar beam paths towards said screen, a control-grid electrode, a screen grid electrode, a low voltage first accelerating and focusing electrode, a high voltage second accelerating and focusing electrode, and a shield cup, the cathodes, the electrodes and the shield cup being longitudinally spaced along a pair of support rods in the order named, the improvement wherein, the low voltage first accelerating and focusing electrode comprises a split member having two spaced apart electrode sections axially separated along a plane substantially perpendicular to the beam paths, the two electrode sections being connected by a first resistor, the two electrode sections normally being operated at substantially the same first potential; and the high voltage second accelerating and focusing electrode comprises a split member having two spaced apart electrode sections axially separated along a plane substantially perpendicular to the beam paths, the two electrode sections being connected by a second resistor, the two electrode sections being normally operated at substantially the same second potential, wherein said second potential is greater than said first potential, said first and second resistors acting as a voltage divider in the event of an arc to limit the voltage difference between electrodes and prevent damaging cascading arcs.

6. In an electron gun comprising at least one cathode for generating an electron beam and a plurality of electrodes for directing said electron beam along a beam path, wherein the improvement comprises a plurality of resistors interconnecting selected ones of said electrodes, one of said resistors being connected between two electrodes operating at substantially the same first potential and another of said resistors being connected between two other electrodes operating at substantially the same second potential, said two electrodes operating at substantially the same first potential comprising two adjacent sections of a first split member, whereby said resistors act as a voltage divider in the event of an arc to limit the current and to prevent damaging cascading arcs.

7. The electron gun as described in claim 6, wherein said two other electrodes operating at substantially the same second potential comprise two adjacent sections of a second split member.

8. The electron gun as described in claim 6, wherein said first split member comprises a low voltage electrode.

9. The electron gun as described in claim 7, wherein said second split member comprises a high voltage electrode.

* * * * *

UNITED STATES PATENT AND TRADEMARK OFFICE

CERTIFICATE OF CORRECTION

PATENT NO. : 4,531,075

DATED : July 23, 1985

INVENTOR(S) : Robert Porter Stone

It is certified that error appears in the above-identified patent and that said Letters Patent is hereby corrected as shown below:

Column 6, Line 44 - "lhat" should be -- that -- ;

Column 8, Line 50 - "354" should be -- 354a -- ; and

Column 12, Line 51 - "1.7 x $^{7}$ ohms" should be -- 1.7 x $10^{7}$ ohms -- .

Signed and Sealed this

*Twenty-ninth* Day of *July 1986*

[SEAL]

*Attest:*

DONALD J. QUIGG

*Attesting Officer*

*Commissioner of Patents and Trademarks*